US008479769B2

(12) United States Patent
Rüb

(10) Patent No.: US 8,479,769 B2
(45) Date of Patent: Jul. 9, 2013

(54) HYDRAULIC VALVE DEVICE

(75) Inventor: Winfried Rüb, Waldshut-Tiengen (DE)

(73) Assignee: Hydac Filtertechnik GmbH, Sulzbach/Saar (DE)

( * ) Notice: Subject to any disclaimer, the term of this patent is extended or adjusted under 35 U.S.C. 154(b) by 412 days.

(21) Appl. No.: 12/734,290

(22) PCT Filed: Sep. 17, 2008

(86) PCT No.: PCT/EP2008/007750

§ 371 (c)(1),
(2), (4) Date: Apr. 22, 2010

(87) PCT Pub. No.: WO2009/062564

PCT Pub. Date: May 22, 2009

(65) Prior Publication Data

US 2010/0307621 A1 Dec. 9, 2010

(30) Foreign Application Priority Data

Nov. 14, 2007 (DE) ..... 10 2007 054 134

(51) Int. Cl.
*F15B 13/043* (2006.01)

(52) U.S. Cl.
USPC ..... 137/596.16; 91/446

(58) Field of Classification Search
USPC ..... 137/97.04, 505.14, 614.7, 596.16, 137/596.18, 87.04, 614.17; 91/446; 60/422
See application file for complete search history.

(56) References Cited

U.S. PATENT DOCUMENTS

| | | | | | |
|---|---|---|---|---|---|
| 3,911,942 | A | * | 10/1975 | Becker | 91/446 |
| 3,984,979 | A | * | 10/1976 | Budzich | 91/446 |
| 4,187,877 | A | * | 2/1980 | Hodgson et al. | 137/596.13 |
| 5,237,908 | A | * | 8/1993 | Kropp | 91/446 |
| 5,715,865 | A | * | 2/1998 | Wilke | 91/446 |
| 5,791,142 | A | * | 8/1998 | Layne et al. | 91/446 |
| 6,192,928 | B1 | * | 2/2001 | Knoell et al. | 91/446 |

FOREIGN PATENT DOCUMENTS

| | | | |
|---|---|---|---|
| DE | 199 29 024 | A1 | 12/2000 |
| DE | 101 35 298 | A1 | 2/2003 |
| DE | 10 2005 033 222 | A1 | 1/2007 |
| EP | 0 686 775 | A1 | 12/1995 |
| EP | 1 370 773 | B1 | 12/2003 |
| EP | 1 500 825 | A2 | 1/2005 |
| EP | 1 710 446 | A2 | 10/2006 |
| WO | WO 02/088550 | A1 | 11/2002 |

* cited by examiner

*Primary Examiner* — John Rivell
(74) *Attorney, Agent, or Firm* — Roylance, Abrams, Berdo & Goodman LLP

(57) ABSTRACT

A hydraulic valve device, especially an LS current regulating valve, includes a fluid connection arrangement (10). As the respective control device (14) associated with a useful connection (A) comprises a control slide (16) upstream of which a pressure balance (18) is mounted in the fluid direction towards each useful connection (A, B), any system vibrations occurring in the load sensing regulating circuit can be better controlled and the respectively connected hydraulic consumer can be subjected to a constant current regulation.

19 Claims, 3 Drawing Sheets

HYDRAULIC VALVE DEVICE

FIELD OF THE INVENTION

The invention relates to a hydraulic valve device, in particular a LS flow control valve, with a fluid connector arrangement containing at least a pressure supply connector (P), a return flow connector (R), a section load sensing connector (LS), two control connectors ($P'_A$) and ($P'_B$), two utility connectors (A, B) and at least one displaceable control for at least partially triggering connectors of the fluid connector arrangement.

BACKGROUND OF THE INVENTION

DE 10 2005 033 222 A1 discloses a LUDV valve arrangement in which a control valve forms an inlet metering orifice to which an individual pressure compensator is connected downstream. By the LUDV valve arrangement, a hydraulic consumer connected to two consumer connectors of the control arrangement is triggered. To set a quick traverse, two pressure spaces of the consumer can be connected to one another and to a source of hydraulic fluid. To prevent sagging of the consumer pressure, this connection of the two consumer connectors takes place by the flow path of the hydraulic fluid having a check valve. By the directional control valve, only the connection to one of the consumer connectors is opened. The connection of the other consumer connector to the source of hydraulic fluid and/or the former consumer connector is possible in quick traverse only via the flow path of the hydraulic fluid and the opened check valve. Inadvertent movement of a hydraulic consumer in the quick traverse position of the valve arrangement is prevented with the known solution. The known LUDV control constitutes a special case of load sensing control in which the highest load pressure of the hydraulic consumer is reported to an adjusting pump. The adjustive pump is controlled such that the pump line contains a pump pressure exceeding the load pressure by a certain pressure difference $\Delta_P$. In the known LUDV control, the individual pressure compensators are located downstream from the metering orifices and choke the fluid flow between the metering orifice and the load so dramatically that the pressure following all metering orifices is the same, preferably equal to the highest load pressure or slightly above it. The greatest weakness of these hydraulic LS systems is their susceptibility to system vibrations in the load sensing control circuit, among other things due to the load change on the respective consumer.

EP 1 370 773 B1 discloses as a hydraulic valve device a directional control valve for controlling the pressure and the flow of hydraulic oil from and to working connectors of at least one fluid consumer, in which the pressure and flow rate can be controlled by a valve spool moveable in the spool bore and actuatable by at least one drive. By annular channels dynamically connected to the fluid consumer, at a symmetry center point of the valve arrangement, a tank connector annular channel (R) and on either side other annular channels one arranged symmetrically. For implementation of hydraulic pump triggering on one side of the axis of symmetry, with an A-annular channel assigned to one working connector, a first pump pressure annular channel, a first load sensing annular channel and a first end space annular channel are assigned. On the other side of the axis of symmetry, with a B-annular channel assigned to the other working connector, a second pump pressure annular channel, a second load sensing annular channel, and a second end space annular channel are assigned. The first load sensing annular channel is connected to the second load sensing annular channel by a load sensing connecting line. With the known valve solution, a type of quantitative divider for the connected consumers is attained. In these quantitative divider valves, the pressure compensators not controlling the pressure drop over the valve orifice, but accept the highest load pressure of the system. Fluctuating pressure losses in the feed line then directly disrupt the available pressure difference on the controller orifice to hinder constant flow control.

SUMMARY OF THE INVENTION

An object of the invention is to provide improved the valve solutions such that system vibrations in the load sensing control circuit can be better managed and such that constant flow control for the respectively connected hydraulic consumer is possible.

This object is basically achieved by a hydraulic valve device where the respective control assigned to each utility connector A, B has a valve spool to which a pressure compensator is connected upstream in the fluid direction to the respective utility connector A, B. The hydraulic LS system is less susceptible to system vibrations. As a result of the upstream pressure compensator, it can have a decisive effect on system stability. Pressure oscillations are often produced by mechanical vibrations of resilient structures in the respectively connected hydraulic consumers (crane arms) and are then transmitted by the load sensing circuit (LS) to the pressure compensator. The LS pressure (load reporting pressure) then constitutes the reference variable for the upstream pressure compensator in this respect and can smooth pressure oscillations even before the pressure is relayed to the following valve spool of the respective control, depending on its respective spool or piston position, then ensures constant supply for the respectively connected hydraulic consumer.

In addition to the indicated system smoothing, by the fluid succession from the pressure compensator with a downstream valve spool, regardless of the pressure difference on the control for the respective consumer, a constant useful volumetric flow is then available so that the total flow rate remains constant independently of changing load pressures on the consumer. In this way reliable operation for the respectively connected hydraulic consumer is ensured.

In one preferred embodiment of the valve device according to the invention, the pressure compensator is integrated within the valve spool. Both the pressure compensator and the valve spool are guided to be longitudinally moveable in relative motion to one another within the valve housing. This coaxial arrangement of the valve spool and pressure compensator is especially space-saving and leads to valve housings with a small structure. This arrangement still is especially reliable.

Shown to be especially reliable in one preferred embodiment of the valve device according to the invention, both the pressure compensator and the valve spool are held spring-centered in the initial position. The pressure compensator is triggerable by a LS pressure routed at the same time to one connection side of the valve spool which in turn can be triggered by the control pressure of a pilot valve. A control connector pressure tapped between the valve spool and pressure compensator triggers the pressure compensator by acting in the opposite direction to the LS pressure.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 1:
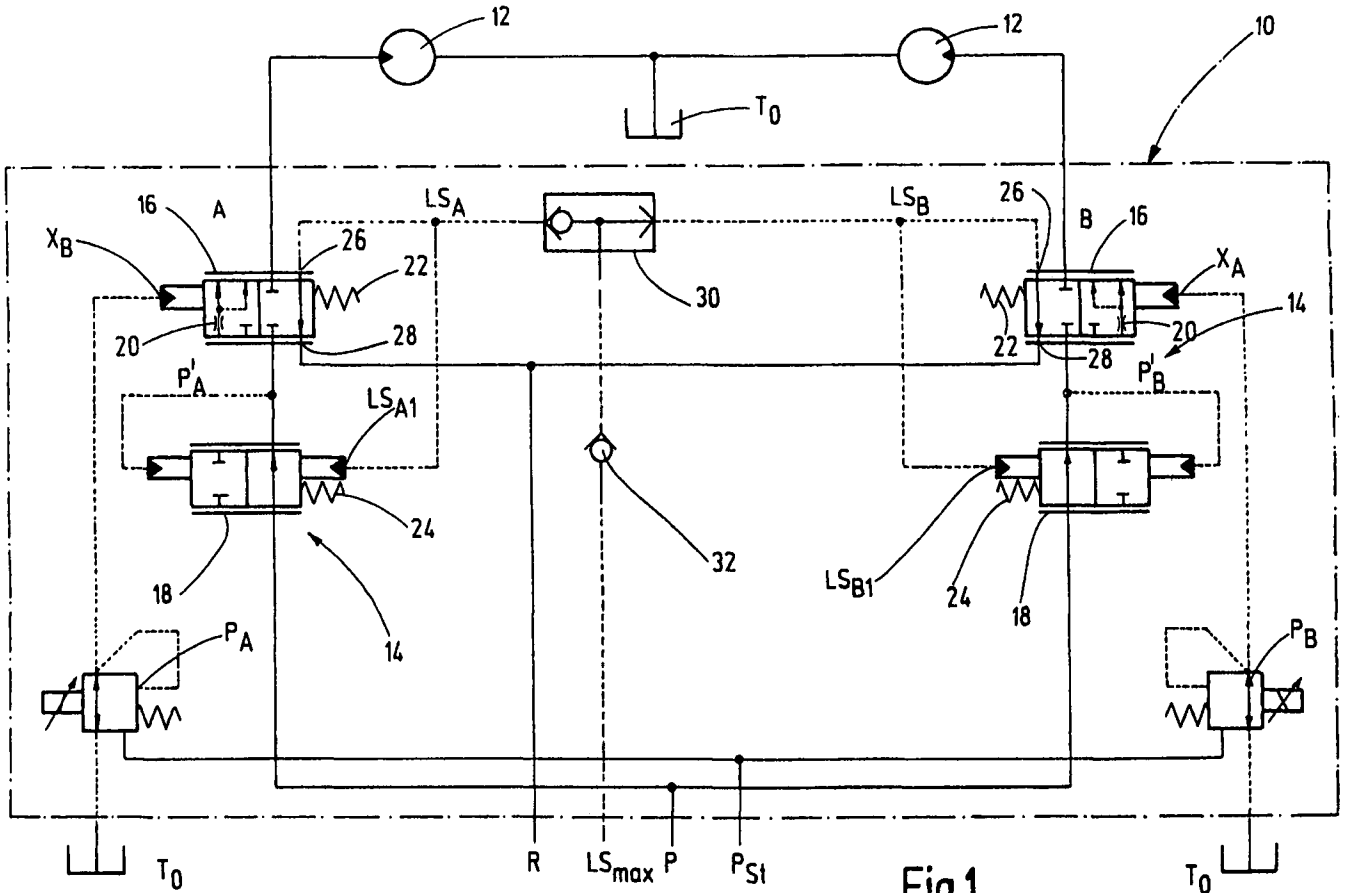
FIG. 1 is a hydraulic circuit diagram of the fundamental structure of the hydraulic valve device in the form of a LS flow control valve according to an exemplary embodiment of the invention.

The hydraulic valve device as shown in FIG. 1 has a fluid connector arrangement 10, containing a pressure supply connector P, a return flow connector R, a section load sensing connector LS with $LS_{max}$, two control connectors $P'_A$, $P'_B$, two utility connectors A, B, and two hydraulic motors 12. Motors 12 are independent of one another, are connected to the utility connectors A, B as consumers and are connected to a common tank connector $T_0$. The hydraulic valve device also has two controls 14 for at least partial triggering of the connectors of the fluid connector arrangement 10. The respective control 14 has, assigned to each utility connector A, B, a valve spool 16 to which a pressure compensator 18 is connected upstream. The valve spool 16 and pressure compensator 18 are built in the form of proportional valves, the respective valve spool 16 being provided with a throttle or orifice 20. Both the pressure compensator 18 and the valve spool 16, as shown in FIG. 1, are held spring-centered in the initial position. The valve spool 16 for this purpose has one compression spring 22 and the pressure compensator 18 having another compression spring 24.

The respective pressure compensator 18 can be triggered by the LS pressure designated as $LS_A$ and $LS_B$ in FIG. 1. This LS pressure $LS_A$, $LS_B$ is also routed at the same time to the connection side 26 of the valve spool 16. The respective valve spool 16 can furthermore be triggered against the action of the compression spring 22 by the control pressure $X_A$, $X_B$ of a conventional pilot valve $P_A$, $P_B$. A control connector pressure $P'_A$ and $P'_B$ tapped between the valve spool 16 and pressure compensator 18 triggers the pressure compensator 18 by acting in the opposite direction to the LS pressure $LS_A$, $LS_B$. The LS pressure prevailing directly at the input of the pressure compensator 18 is designated as $LS_{A1}$, and $LS_{B1}$.

Another connection side 28 of the valve spool 16 is connected to a return flow connector R and the LS pressure $LS_A$ and $LS_B$ can be triggered by a selector valve 30 connected by a check valve 32 to $LS_{max}$. The check valve 32 opens in the direction of $LS_{max}$. The pilot valves $P_A$, $P_B$ are connected to a control pressure $P_{ST}$ as the supply source and further to the tank connector $T_0$.

Figure 2:
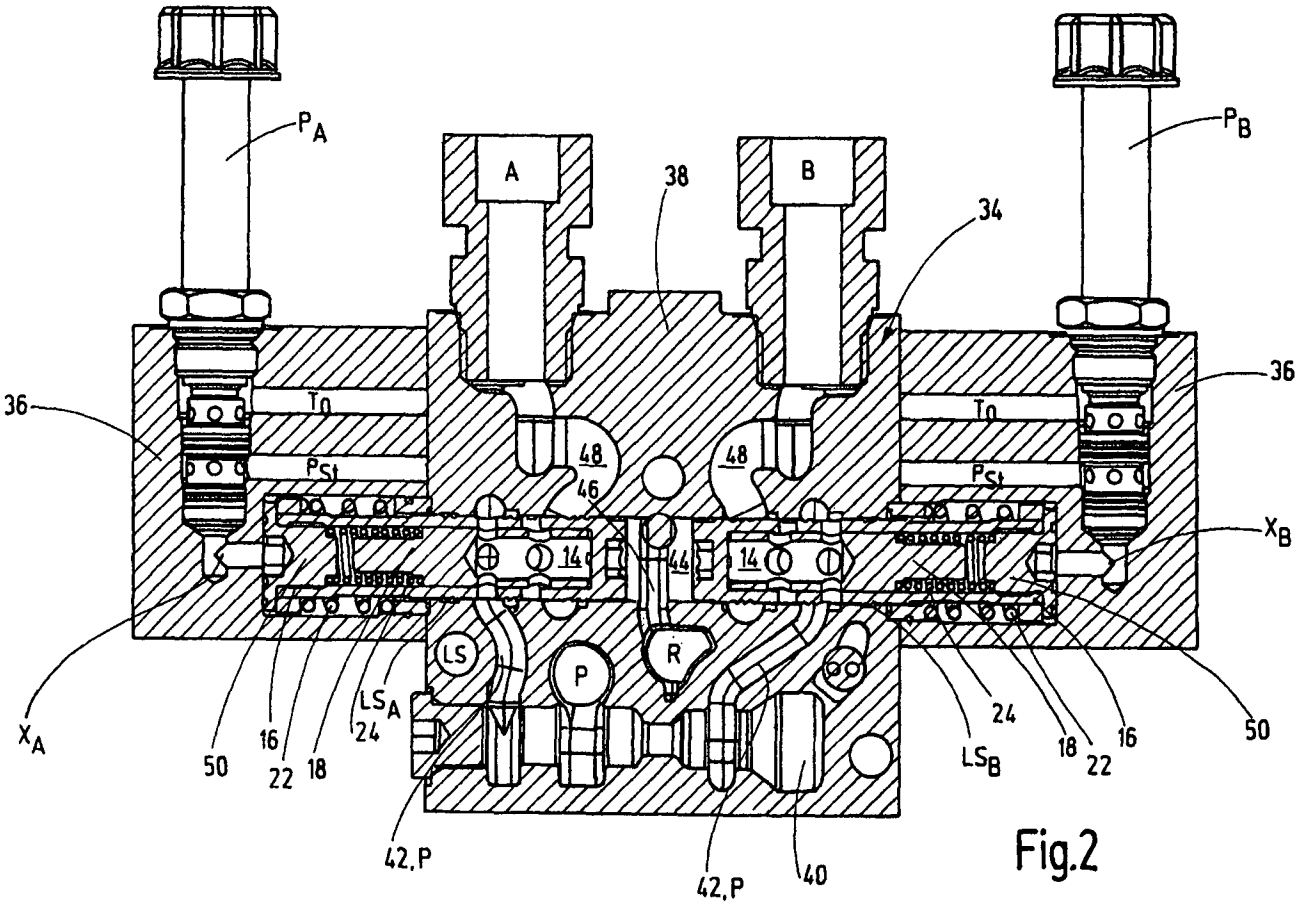
FIG. 2 is a front elevational view in section of a practical implementation of the circuit diagram of FIG. 1 in a valve product shown in part with its essential components.

The hydraulic valve device of FIG. 1 in the form of a hydraulic circuit diagram is shown as a mechanical valve solution according to the longitudinal section as shown in FIG. 2. The valve device has a valve housing 34 implemented as a modular concept. In particular, the pilot valves $P_A$, $P_B$ with their connection housing parts 36 are connected to the middle housing 38. As viewed in the direction of FIG. 2 in the upper region of the middle housing 38, the utility connectors A, B are connected in the form of screw-in cartridges. The lower region of the middle housing 38 is penetrated by a through channel 40 in which overall the pump pressure P prevails. Channel 40 is connected via connector lines 42 to a middle channel bore 44 into which the two control 14 are inserted. Analogously to the through channel 40, the middle channel bore 44 also extends transversely to the center longitudinal axis of the overall valve housing 34 and along this center longitudinal axis which is not detailed, viewed in the direction of FIG. 2, underneath the middle channel bore 44 is the return flow connector R which discharges into the middle channel 44 via another connector line 46. The middle channel 44 is preferably made in the form of a bore and is connected by connecting lines 48 to the utility connectors A, B to carry fluid. The check valve 32 in FIG. 1 is likewise integrated in the valve housing 34, but for reasons of simplification is not shown in FIG. 2.

The axis of the respective valve spool 16 extends horizontally as viewed in FIG. 2. The middle channel bore 44 in the middle housing 38 is sealed on both sides with the respective pilot housing as the connector housing part 36 for the supply of a trigger pressure $X_A$, $X_B$. Outside the valve middle is the return flow connector R. Viewed from the return flow connector R, on one side A, P, and $LS_A$ follow to the outside, and B, P and $LS_B$ follow on the opposite side. As already described, the LS annular channels $LS_A$ and $LS_B$ are connected to the selector valve 30 which separates the two pressures from one another. The selector valve 30 is preferably made as a round insert part and is mounted on the flange side (not shown) of the disk-like valve body 34. The output connector of the selector valve 30 leads, by the pressure channel, to the check valve 32 sealing against higher pressure in the LS reporting channel ($LS_{max}$). If the load pressure $LS_A$ or $LS_B$ exceeds the pressure in the reporting channel, this pressure is relayed by the check valve 32 in the control block and from there further to a system pressure control (not shown) for the entire valve system.

The entire space in the form of the through channel 40 in the lower part of the middle housing 38 is under the pump pressure P. From this space, one channel line at a time leads to the cavity axis of the respective valve spool 17 to the vicinity of the annular channels leading to utility connectors A and B. The two valve spools 16 are made identically and in a coaxial arrangement hold an inside pressure compensator 18 connected upstream from the valve orifice. They are also structurally identical to one another. As shown in FIG. 2, the neutral positions of the valve spools 16 are held by housing-mounted stops and their respective working springs (compression springs 22). The working spring (compression spring 22) is supported on the one hand against the housing 34 of the valve and on the other hand against a screw plug 50 screwed tightly to the valve spool 16. In this initial or neutral position, the respective valve spool 16 separates the working connector A or B from the pump connector P.

Figure 3:
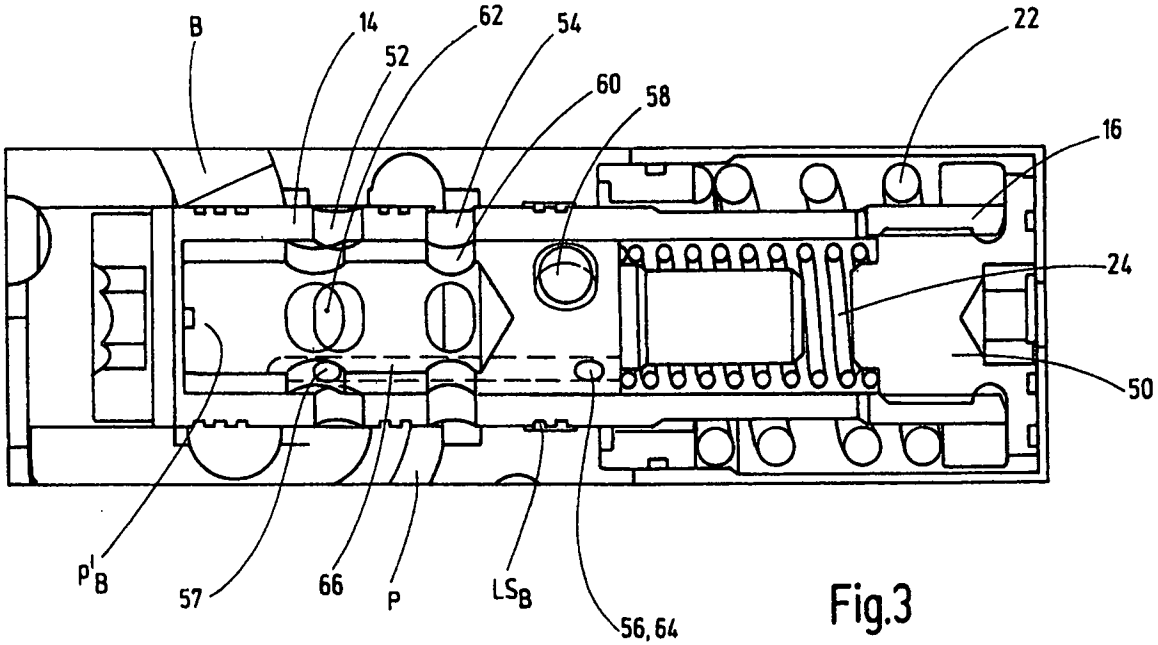
FIG. 3 is an enlarged front elevational view in section of the control at right when viewed in the direction of FIG. 2, with a pressure compensator and valve spool.

As FIG. 3 shows in particular, the variable valve orifice is made in the form of first radial openings 52 within the hollow spool arrangement of the valve spool 16 and pressure compensator 18. A sealing crosspiece P to A and P to B is formed within the valve housing 34. The inner pressure compensator 18 is also permanently connected to the pump channel P by second radial openings 54 in the valve spool 16. The spring chamber with the other compression spring 24 of the pressure compensator 18 is permanently connected to the respective $LS_A$ or $LS_B$ annular channel by third radial openings 56 in the valve spool 16. In the neutral position, the third radial openings 56 of the valve spool 16 are additionally connected to the spring chamber with the compression spring 22 of the valve spool 16 to carry pressure. This connection takes place through the corresponding radial passages in the control piston of the pressure compensator 18. The indicated spring chamber of the pressure compensator 18 is then relieved in the neutral position. The valve spool 16 can be provided with fourth radial openings 57 whose edge lying toward the valve center is at the same axial length as the first openings (control edge 52). These fourth openings 57, in contrast to the first three openings, do not have corresponding passages in the control piston of the pressure compensator 18. The correct orientation of the corresponding openings with passages is ensured by a locking element 58 in the form of a catch ball offering radial protection between the valve spool 16 and the control piston of the pressure compensator 18.

In the unpressurized state the control spring 24 presses the control piston of the pressure compensator 18 against the end of the blind hole of the valve spool 16. This pressure compensator piston is likewise made as a hollow piston and has a second radial passage 60 closing the connection to the opening 54 as a P-opening in the valve spool 16 in the stroke against the pressure compensator spring 24 (control edge of the pressure compensator 18). A first radial passage 62 is permanently connected to the valve orifice in the form of the first opening 52 in the valve spool 16. The spring chamber of the pressure compensator 18 is connected by the third radial opening 56 to the respective third passage 64 of the valve spool 16 and to the longitudinal grooves 66 on the jacket or outer surface of the control piston of the pressure compensator 18. These longitudinal grooves 66, of which only one is shown by the broken line in FIG. 3, extend in the direction of the R channel to the control edge of the control piston. Viewed on the periphery, grooves 66 lie between the radial openings and passages. The respective longitudinal groove 66 is permanently connected to the fourth radial opening 57 in the valve spool 16. This longitudinal groove connection constitutes the LS reporting connector from the working connector into the spring chamber with the compression spring 24 of the pressure compensator 18. The connection site 57, as shown in FIG. 1, corresponds to the branch point $LS_B$, the opening 56 on one input control side of the pressure compensator 18 forms the repotting connector $LS_{B1}$, and the above designated LS pressure $LS_B$ constitutes the sensing connector.

When the pump pressure prevails over the pump connector P, this pressure also acts in the $P'_A$ or $P'_B$ chamber of the pressure compensator 18 and presses the control piston against the spring until the corresponding control edge closes. The $P'_A$ and $P'_B$ pressure is then adjusted exactly to the amount of the control spring 24 of the pressure compensator 18. The aforementioned radial openings and passages, as also shown in FIG. 3, can be arranged repeatedly along the outer peripheries of the valve spool 16 and control piston of the pressure compensator 18.

If, at this point, a pilot pressure is selected by the pilot valves $P_A$ or $P_B$, the pilot valve preferably being an electro-hydraulic pressure reducing valve, with central supply from a control oil circuit $P_{St}$, the valve spool 16 is pushed against the spring force of the compression spring 22 in the direction of the R channel (compare FIG. 2). The valve orifice then begins to open an opening cross section between the pressure compensator 18 and the respective working connector A or B. Accordingly the $P'_A$ or $P'_B$ pressure breaks through because volume is draining. The control spring 24 can then push the control piston in the direction of the opening control edge. Oil continues to flow out of the pump connector P until upstream from the valve orifice a dynamic pressure is formed again which is in equilibrium of forces with the control spring and the reported load pressure. The load pressure is then reported from the fourth radial opening 57 of the valve spool 16 into the longitudinal groove 66 which can likewise extend repeatedly around the periphery of the control piston, and is routed from there through the third radial opening 64 in the control piston into the spring chamber with the other compression spring 24. With the solution according to the invention, a system-stable valve device is defined to perform a LS flow control function in a space-saving manner.

While one embodiment has been chosen to illustrate the invention, it will be understood by those skilled in the art that various changes and modifications can be made therein without departing from the scope of the invention as defined in the appended claims.

What is claimed is:

1. A hydraulic LS flow control valve, comprising:

a fluid connector arrangement of a pressure supply connector, a return flow connector, a section load sensing connector, first and second control connectors and first and second utility connectors;

at least one control connected to said connectors to trigger said connectors, said control including a first valve spool and a first pressure compensator connected upstream thereto in a flow direction to said first utility connector and a second valve spool and a second pressure compensator connected upstream thereto in a flow direction to said second utility connector, each said valve spool and each said pressure compensator being biased by springs to centered, initial positions thereof, each said pressure compensator being operable by a LS pressure conveyed simultaneously to a first connection side of the respective valve spool, each said valve spool being operable by a respective control pressure of a respective pilot valve;

a line tapping pressure between each said valve spool and the respective pressure compensator being connected to a connection side of the respective pressure compensator to act in an opposite direction of the LS pressure applied thereto; and a second connection side of each said valve spool being connected to said return flow connector routed essentially along a middle axis of a valve housing containing said valve spools and said pressure compensators between said valve spools and the respective pressure compensators in the initial position thereof.

2. A hydraulic LS flow control valve according to claim 1 wherein each said pressures compensator is integrated in the respective valve spool; and each said valve spool and the respective pressure compensator are guided in a valve housing to be longitudinally displaceable relative to one another.

3. A hydraulic LS flow control valve according to claim 1 wherein a selector valve receives respective LS pressures from said pressure compensators and conveys a higher of the LS pressures to a check valve.

4. A hydraulic LS flow control valve according to claim 1 wherein each said unit connector is connected to the respective valve spool in fluid communication.

5. A hydraulic LS flow control valve according to claim 1 wherein each said valve spool and the respective pressure compensator comprises hollow pistons being guided within one another and having radial fluid openings and fluid passages with some of said fluid openings and said fluid passages thereof forming said sensing connector and a reporting connector.

6. A hydraulic LS flow control valve according to claim 5 wherein each said sensing connector and the respective reporting connector are interconnected by a longitudinal groove.

7. A hydraulic LS flow control valve according to claim 1 wherein each said pressure compensator is held by a locking element relative to the respective valve spool.

8. A hydraulic LS flow control valve according to claim 1 wherein a valve housing comprises a through channel being a distributor and being connected to said pressure supply connector to said valve spools and said pressure compensators.

9. A hydraulic LS flow control valve, comprising:

a fluid connector arrangement of a pressure supply connector, a return flow connector, a section load sensing connector, first and second control connectors and first and second utility connectors;

at least one control connected to said connectors to trigger said connectors, said control including a first valve spool and a first pressure compensator connected upstream thereto in a flow direction to said first utility connector and a second valve spool and a second pressure compensator connected upstream thereto in a flow direction to said second utility connector; and a selector valve receiving respective LS pressures from said pressure compensators and conveying a higher of the LS pressures to a check valve.

10. A hydraulic LS flow control valve according to claim 9 wherein each said sensing connector and the respective reporting connector are interconnected by a longitudinal groove.

11. A hydraulic LS flow control valve according to claim 9 wherein a valve housing comprises a through channel being a distributor and being connected to said pressure supply connector to said valve spools and said pressure compensators.

12. A hydraulic LS flow control valve, comprising:

a fluid connector arrangement of a pressure supply connector, a return flow connector, a section load sensing connector, first and second control connectors and first and second utility connectors;

at least one control connected to said connectors to trigger said connectors, said control including a first valve spool and a first pressure compensator connected upstream thereto in a flow direction to said first utility connector and a second valve spool and a second pressure compensator connected upstream thereto in a flow direction to said second utility connector; and each said valve spool and the respective pressure compensator including hollow pistons being guided within one another and having radial fluid openings and fluid passages with some of said fluid openings and said fluid passages thereof forming said sensing connector and a reporting connector.

13. A hydraulic LS flow control valve according to claim 12 wherein each said sensing connector and the respective reporting connector are interconnected by a longitudinal groove.

14. A hydraulic LS flow control valve according to claim 13 wherein each said pressure compensator is held by a locking element relative to the respective valve spool.

15. A hydraulic LS flow control valve, comprising:

a fluid connector arrangement of a pressure supply connector, a return flow connector, a section load sensing connector, first and second control connectors and first and second utility connectors;

at least one control connected to said connectors to trigger said connectors, said control including a first valve spool and a first pressure compensator connected upstream thereto in a flow direction to said first utility connector and a second valve spool and a second pressure compensator connected upstream thereto in a flow direction to said second utility connector, each said pressure compensator being held by a locking element relative to the respective valve spool.

16. A hydraulic LS flow control valve, comprising:

a fluid connector arrangement of a pressure supply connector, a return flow connector, a section load sensing connector, first and second control connectors and first and second utility connectors;

at least one control connected to said connectors to trigger said connectors, said control including a first valve spool and a first pressure compensator connected upstream thereto in a flow direction to said first utility connector and a second valve spool and a second pressure compensator connected upstream thereto in a flow direction to said second utility connector, each said pressure compensator being operable by a LS pressure conveyed simultaneously to a first connection side of the respective valve spool, each said valve spool being operable by a respective control pressure of a respective pilot valve;

a line tapping pressure between each said valve spool and the respective pressure compensator being connected to a connection side of the respective pressure compensator to act in an opposite direction of the LS pressure applied thereto; and a selector valve receiving respective LS pressures from said pressure compensators and conveying a higher of the LS pressures to a check valve.

17. A hydraulic LS flow control valve according to claim 16 wherein each said unit connector is connected to the respective valve spool in fluid communication.

18. A hydraulic LS flow control valve according to claim 16 wherein each said sensing connector and the respective reporting connector are interconnected by a longitudinal groove.

19. A hydraulic LS flow control valve according to claim 16 wherein each said pressure compensator is held by a locking element relative to the respective valve spool.

* * * * *